US006135387A

United States Patent [19]

Seidel et al.

[11] Patent Number: 6,135,387

[45] Date of Patent: Oct. 24, 2000

[54] METHOD FOR AUTONOMOUS GUIDANCE OF A SPIN-STABILIZED ARTILLERY PROJECTILE AND AUTONOMOUSLY GUIDED ARTILLERY PROJECTILE FOR REALIZING THIS METHOD

[75] Inventors: Wolfgang Seidel, Braunschweig; Frank Guischard, Celle, both of Germany

[73] Assignee: Rheinmetall W&M GmbH, Unterluss, Germany

[21] Appl. No.: 09/156,042

[22] Filed: Sep. 7, 1998

[30] Foreign Application Priority Data

Sep. 17, 1997 [DE] Germany ..... 197 40 888

[51] Int. Cl.[7] ..... F41G 7/34

[52] U.S. Cl. ..... 244/3.15; 244/3.1; 244/3.23; 244/3.24

[58] Field of Search ..... 244/3.1, 3.11, 244/3.15, 3.16, 3.19, 3.2, 3.21–3.29

[56] References Cited

U.S. PATENT DOCUMENTS

| | | | |
|---|---|---|---|
| 5,102,065 | 4/1992 | Couderc et al. | 244/3.11 |
| 5,478,028 | 12/1995 | Snyder | 244/3.11 |
| 5,647,558 | 7/1997 | Linick . | |
| 5,685,504 | 11/1997 | Schneider et al. | 244/3.11 |
| 5,775,636 | 7/1998 | Vig et al. . | |
| 5,855,339 | 1/1999 | Mead et al. | 244/3.11 |

FOREIGN PATENT DOCUMENTS

| | | |
|---|---|---|
| 30 13 405 C2 | 10/1981 | Germany . |
| 44 01 315 A1 | 8/1995 | Germany . |
| WO98/01719 | 1/1998 | WIPO . |

*Primary Examiner*—Bernarr E. Gregory
*Attorney, Agent, or Firm*—Venable; Norman N. Kunitz

[57] ABSTRACT

A method for the autonomous guidance of a spin-stabilized artillery projectile (2; 25) toward a target (12). To ensure that an autonomously guided, spin-stabilized artillery projectile (2; 25) hits a target (12) with high precision, even at distances of ≧35 km, previously determined target data are transmitted to the projectile (2; 25) and stored therein before it is fired, and, following the firing of the projectile (2; 25), these stored data are compared with projectile position data, detected with the aid of a satellite navigational receiving station (23). The correction data resulting from this comparison are then used for the projectile (2; 25) guidance. Shortly before reaching the guidance phase, the velocity of the projectile is reduced by the use of spin-stabilized brakes and the projectile flight is changed for purposes of guidance from a spin-stabilized to a fin-stabilized flight state, wherein the projectile (2; 25) is then guided aerodynamically by means of rotating fins (9), arranged on the nose side, which can swing out, and wherein the spin-stabilized brakes function as lift surfaces once they are locked in place.

9 Claims, 4 Drawing Sheets

METHOD FOR AUTONOMOUS GUIDANCE OF A SPIN-STABILIZED ARTILLERY PROJECTILE AND AUTONOMOUSLY GUIDED ARTILLERY PROJECTILE FOR REALIZING THIS METHOD

REFERENCE TO RELATED APPLICATIONS

This application claims the priority of German application Serial No. DE 197 40 888.5 filed Sep. 17, 1997, which is incorporated herein by reference.

BACKGROUND OF THE INVENTION

The invention relates to a method for the autonomous guidance of a spin-stabilized artillery projectile toward a stationary or mobile target. The invention furthermore relates to an autonomously guided, i.e., self-guided, spin-stabilized artillery projectile for realizing this method.

The autonomous guidance of artillery projectiles is described in an article by P. Runge, "Intelligente Ammunition" [Intelligent Ammunition]: Yearbook for Military Technology, issue 16, pp 202–211, Publishing House Bernard & Graefe, 1986.

As a rule, such projectiles are ammunition concepts with a relatively involved design, which must autonomously locate the respective target in its environment upon approaching a target area, must track this target through a corresponding correction in the trajectory and must subsequently hit this target directly. The trajectory is corrected with the aid of micro-reaction mechanisms or aerodynamic positioning systems.

The known projectiles have the disadvantage, among other things, of requiring a cost-intensive sensor technology (homing head).

It is the object of the present invention to provide a method allowing an autonomous, spin-stabilized artillery projectile to hit a target with high precision, even at great distances (e.g. at distances of $\geqq 35$ km). In addition, an artillery projectile for realizing this method is to be disclosed.

SUMMARY OF THE INVENTION

The above object is achieved with respect to the method by a method for autonomous guidance of a spin-stabilized artillery projectile toward a stationary or a mobile target, which comprises the steps of: a) prior to firing of the projectile, transmitting previously determined target data and control data, which initially fix the projectile flight course toward the target, as reference data to an electronic control device with memory of the projectile; b) after the projectile is fired, measuring the actual position of the projectile with the aid of at least one satellite navigational receiver, disposed in the projectile, and comparing, with the aid of the electronic control device, the measured position data and the reference data transmitted to the control device prior to firing, to obtain correction values; c) reducing the velocity and the spin of the projectile at a given distance from the firing position with the aid of swing-out, spin-stabilized brake fins to realize the guidance of the projectile, such that the projectile flight changes from a spin-stabilized flight to a fin-stabilized flight condition, and by making use of the spin-stabilized brake fins as lift surfaces after the brake fins are immovably fixed; and, d) correcting the correction values obtained as a result of the comparison to corresponding signal values, and using these signal values to effect an aerodynamic guidance of the projectile to the target by control of pivoting, rotating projectile fins that can be swung out of the projectile. The above object is achieved with respect to the projectile, by an autonomously guided, spin-stabilized artillery projectile, which comprises: a) a projectile body; b) a parachute brake that can be jettisoned and a spin-stabilized brake, composed of several fold-out fins, arranged at a tail region of the artillery projectile body; c) a plurality of rotating fins, designed for the projectile guidance, located in front of a mass center of the projectile and distributed over the circumference of the projectile body, with the fins being mounted to be pivoted outwardly via servomotors and to be swing back and fitted, via slots in the circumference of the projectile body, into the projectile body; d) at least one satellite navigational receiver system arranged in the projectile body as a sensor for determining the projectile position; and, e) an electronic control device which is disposed in the projectile body and which determines trajectory correction data as well as the respective roll position of the projectile from target data transmitted to this projectile prior to firing and stored in a memory of the device as well as from projectile position data determined during flight by the satellite navigational receiver system, and which then determines control data for the servomotors during a guidance phase from the resulting data and subsequently transmits said control data to the servomotors for guiding the projectile after it has slowed down, the spin-stabilization of the projectile has ended and the rotating fins are extended. Further advantageous embodiments and modification of the invention are disclosed.

The invention essentially is based on the idea of completely omitting an involved sensing technology, e.g. a homing head, for determining the information needed for the guidance. Rather, the previously determined target data is transmitted to the projectile before it is fired and, following the firing, these data are compared continuously or during predetermined time intervals with the projectile position data, detected by means of a satellite navigational receiver. The correction data resulting from this comparison are then used for the projectile guidance. For this, the projectile flight is changed prior to reaching the guidance phase from a spin-stabilized to a fin-stabilized flight condition, thus resulting in an aerodynamic guidance of the projectile by means of rotating fins, arranged on the nose or tip end, which can swing out.

Further details and advantages of the invention follow from the exemplary embodiments explained with the aid of figures:

DETAILED DESCRIPTION OF THE PREFERRED EMBODIMENTS

Figure 1:
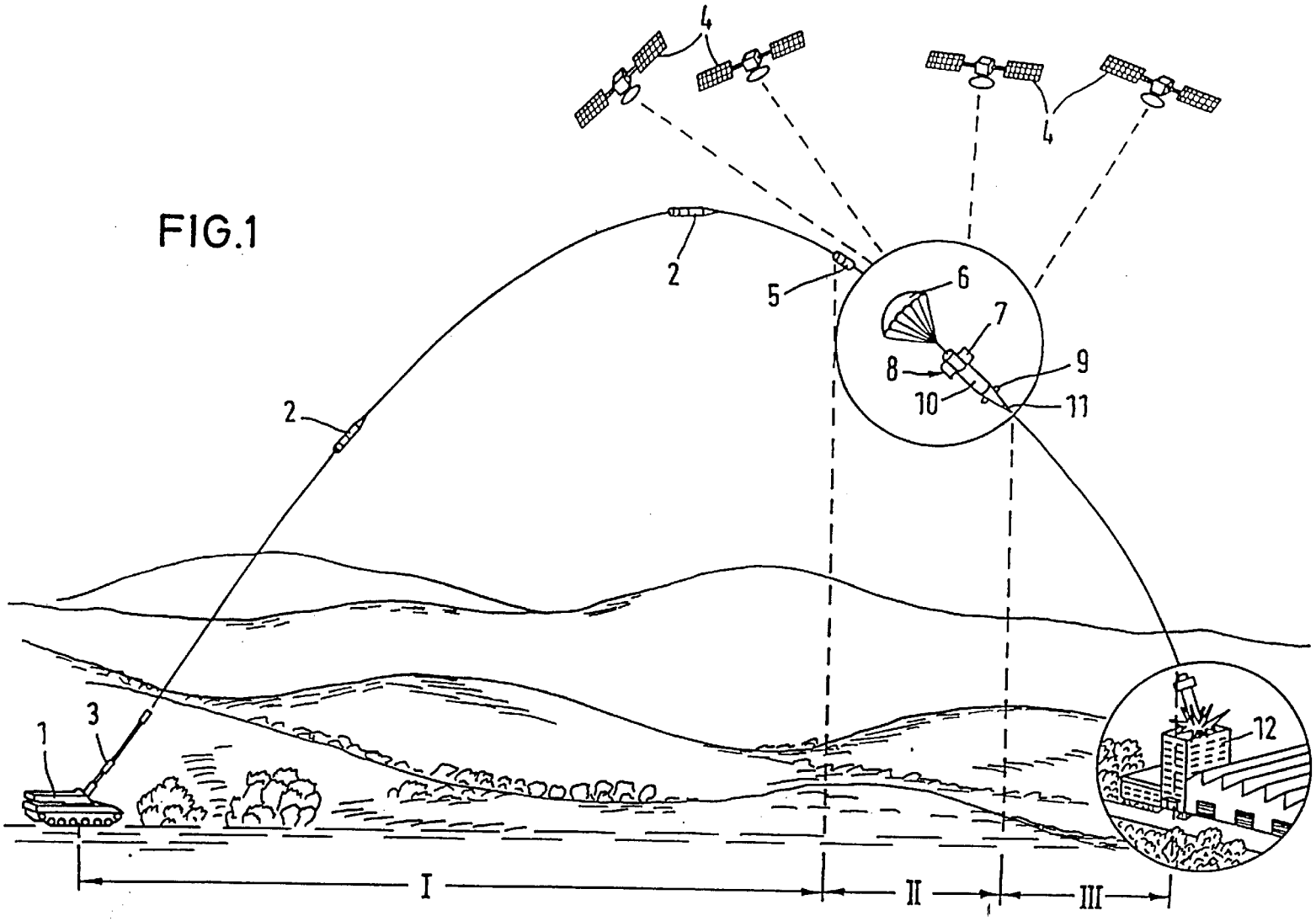
FIG. 1 shows the flight course of an artillery projectile according to the invention, e.g. fired from an armored howitzer.

In FIG. 1, the number 1 indicates an armored howitzer and the number 2 a spin-stabilized artillery projectile, fired from the howitzer, which projectile 2 is shown at various points in time along its flight trajectory. The projectile 2 has an on-board electronic control arrangement or unit 22 with memory to which target position data and projectile control data are transmitted in a combined manner either before or after the projectile is loaded into the corresponding weapon 3 of the howitzer 1, e.g., by means of an inductive data transmission system.

Following the firing, the projectile 2 initially flies along a ballistic trajectory until it reaches a predetermined distance from the weapon, indicated by I in FIG. 1. During this phase, the position, velocity and roll position of the projectile are determined continuously with the aid of a satellite navigational receiver system (GPS receiver system) installed in the projectile 2, as well as additional sensors. The reference number 4 in FIG. 1 indicates the GPS satellites necessary for the navigation, wherein the number of satellites 4 can vary.

If, as indicated in FIG. 1, a projectile 2 with base bleed unit 5 for reducing the projectile base drug is used and the distance I has been reached, the non-burnt parts of the base bleed unit 5 are jettisoned from the projectile during an intermediate phase II. The base-bleed unit 5 is further shown in FIG. 2.

In order to change the projectile 2 from a spin-stabilized to a fin-stabilized flight condition, a parachute brake 6, which brakes the projectile velocity to approx. 200 m/s, is additionally opened up during the intermediate phase II, initially to reduce the projectile velocity, and which is then cut after the projectile 2 has been slowed, and a spin-stabilized brake 8, e.g., consisting of three fins 7, is unfolded, thereby further slowing the spin down to a roll rate of <10 Hz, and is locked in place in the opened position. If the projectile roll, rate is <10 Hz, then the spin-stabilized brake fins 7 have the effect of stabilizing the projectile in the manner of lift surfaces, which replaces the spin-stabilization.

The rotating fins 9 (e.g., four), which are necessary for guiding the projectile 2, can then swing out in the projectile 2 region (compare also FIG. 3) that is located in front of the mass center 10 of the projectile, and the projectile 2 is guided during the guidance phase indicated with III in FIG. 1.

If projectile 2 is a full-caliber high explosive projectile, for example, the ignition can be initiated with a percussion primer 11, as soon as it impacts with the corresponding target 12.

Figure 2:
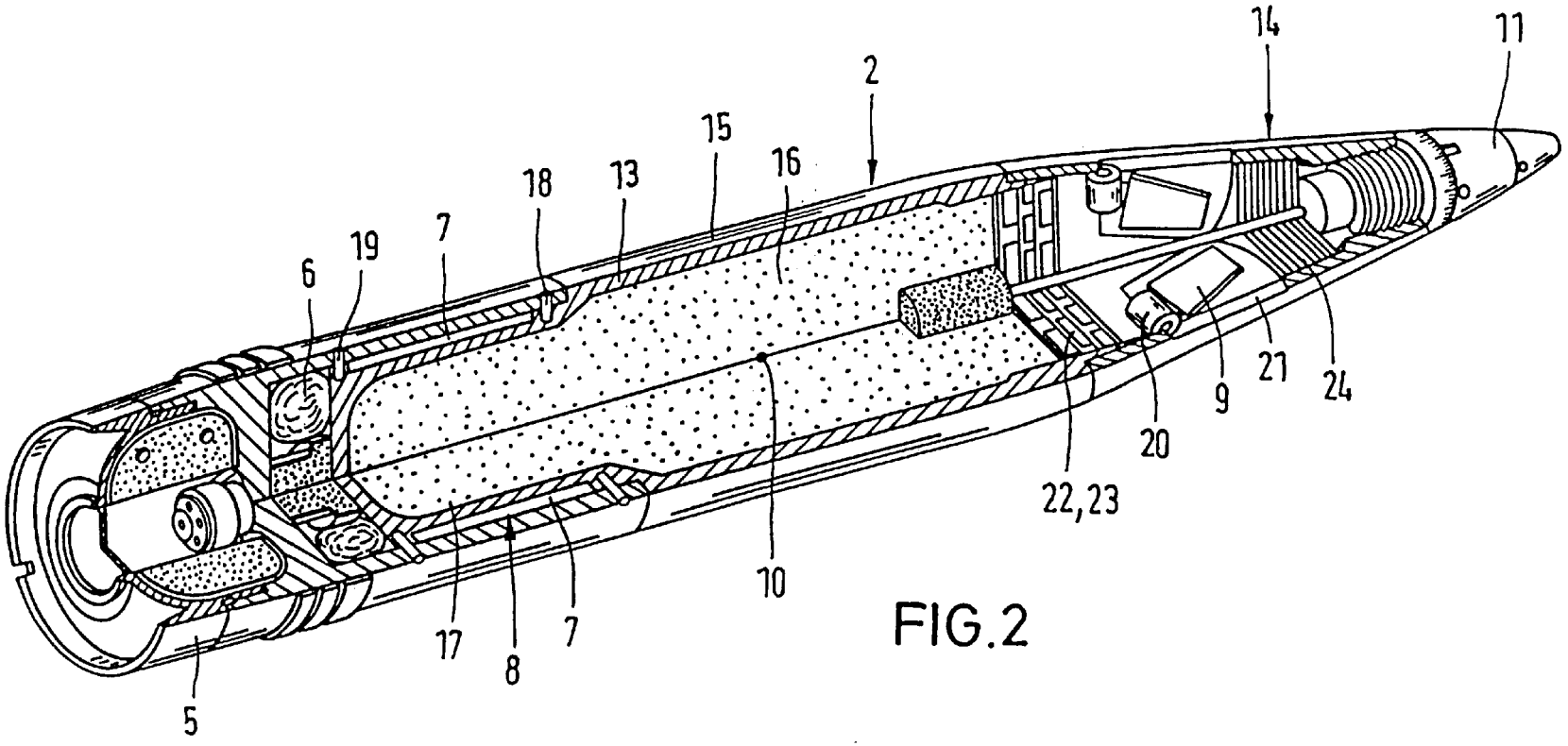
FIG. 2 shows a longitudinal section through the artillery projectile indicated in FIG. 1, during the spin-stabilized flight phase.

FIG. 2 shows a first exemplary embodiment of a projectile 2 according to the invention, having a base bleed unit 5 arranged at the tail region of the projectile body or shell 13. The projectile 2 is provided with a projectile body or shell 13 having an ogive-shaped nose section 14. The central, cylindrical region 15 of projectile shell 13 comprises a large-volume payload area where an explosive charge 16, for example, is arranged. The tail region or section 17 of the explosive charge 16 is surrounded by the three swing-out fins 7 of the spin-stabilized brake 8, which in turn is surrounded by a cylindrical extension of the base bleed unit. Several pins 18, 19 serve to connect the tail part to the projectile shell 13. The parachute brake 6 is arranged between the base bleed unit 5 and the high-explosive charge 16.

The rotating fins 9, which are attached to servomotors 20 such that they can swing out, are arranged in the ogive-shaped nose section of projectile shell 13, which fins 9 can swing or pivot out through corresponding openings 21 in the projectile shell 13. The ogive-shaped nose section 14 of projectile shell 13 also houses the electronic control device 22 with the GPS receiver system 23 and a power source 24, designed to supply power to servomotors 20, the control device 22 as well as other electronic components.

Figure 3:
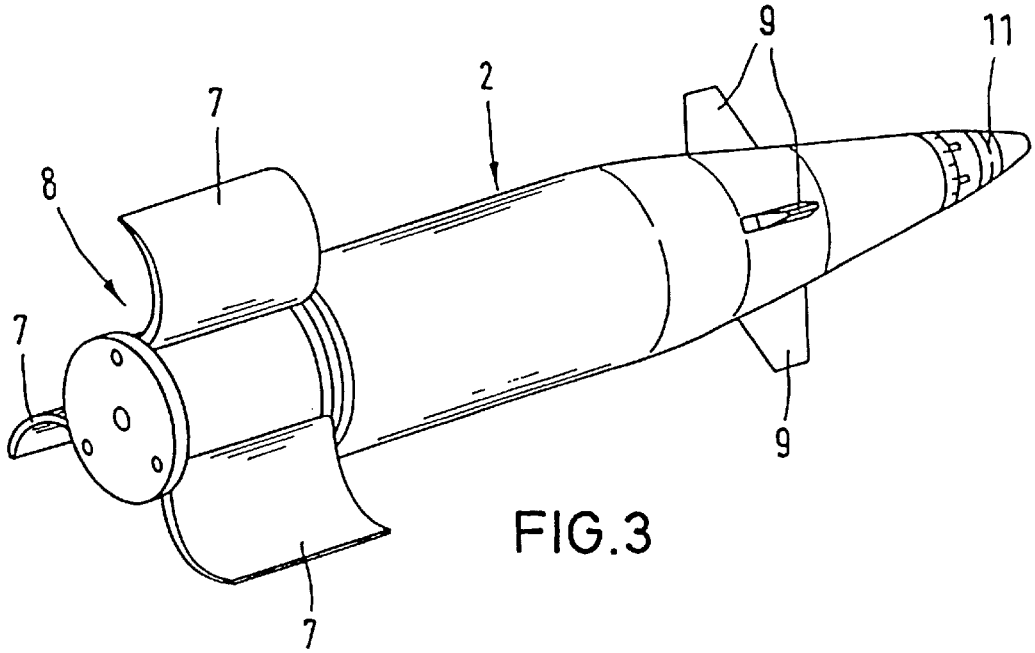
FIG. 3 shows a side view of the artillery projectile shown in FIG. 1, during its fin-stabilized flight phase.

Of course, the invention is not limited to the exemplary embodiment shown in FIGS. 1–3. Thus, the artillery projectile can also be designed as submunition carrier projectile in place of the full caliber high explosive projectile. The advantage of such an arrangement is that following the guidance phase, the submunition projectile can be fired at high velocity from the carrier projectile toward the target.

Figure 4:
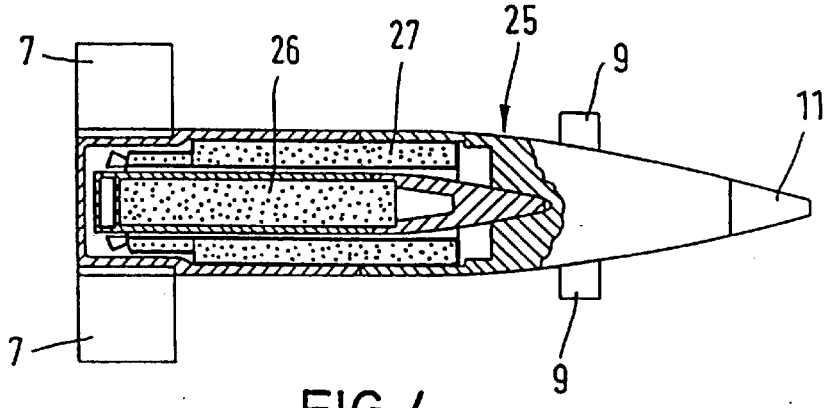
FIG. 4 shows a longitudinal section through another exemplary embodiment of a projectile according to the invention, with integrated submunition projectile.
Figure 5:
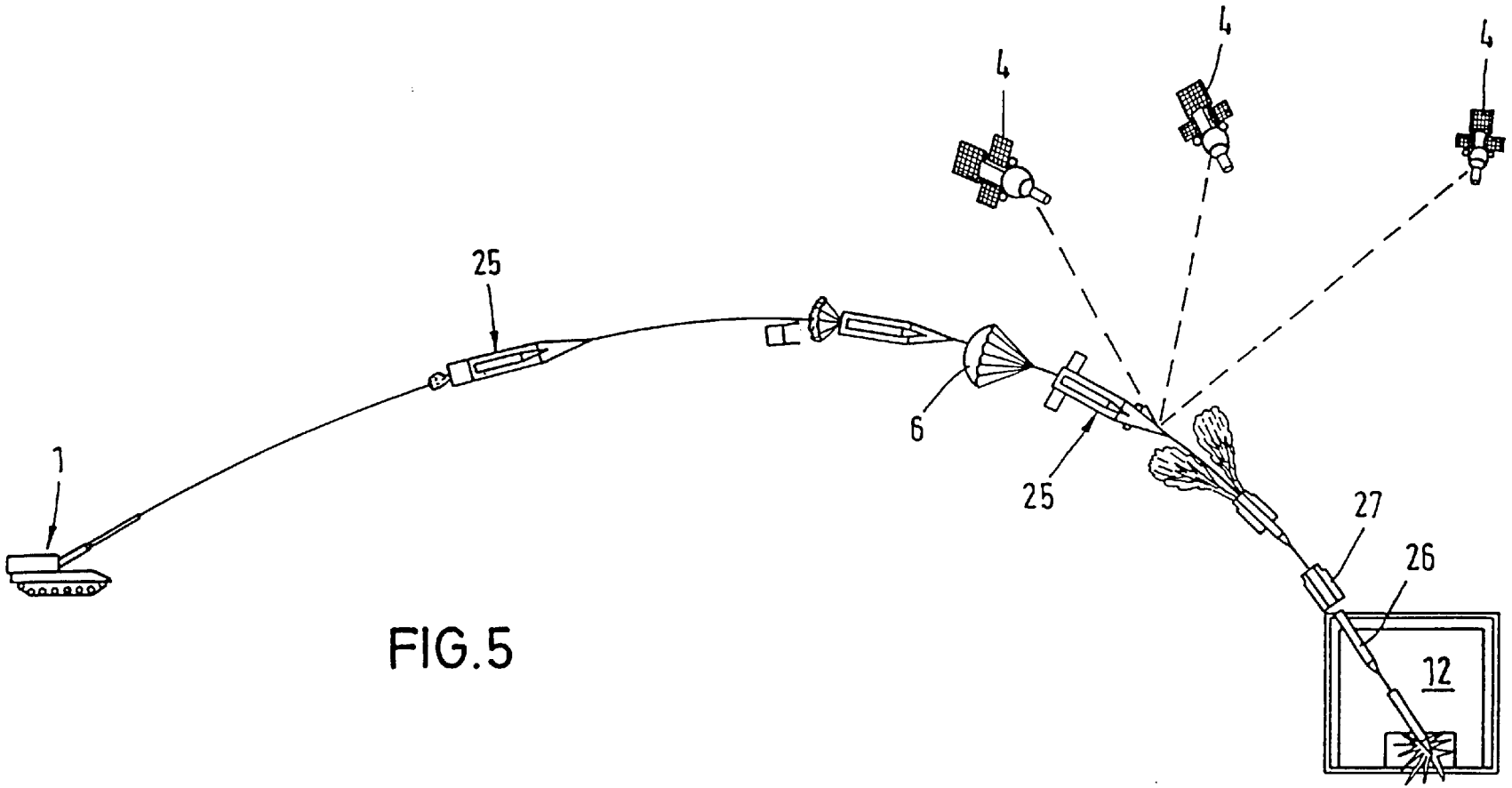
FIG. 5 shows the flight course, corresponding to FIG. 1, of the artillery projectile shown in FIG. 4.

FIGS. 4 and 5 show one exemplary embodiment of such a projectile arrangement in the guidance phase, as well as the flight course according to FIG. 1 of this projectile arrangement. The carrier projectile here is given the reference 25 and the submunition projectile the reference 26. As follows from FIG. 4, the submunition projectile 26 is surrounded by a missile propellant 27, which causes an additional acceleration of the submunition projectile, e.g., from 200 m/s to <400 m/s, upon percussive ignition (compare also FIG. 5). Other payloads are also conceivable, e.g. seeking fuze submunition, bomblets, etc.

The invention now being fully described, it will be apparent to one of ordinary skill in the art that many changes and modifications can be made thereto without departing from the spirit or scope of the invention as set forth herein.

What is claimed:

1. A method for autonomous guidance of a spin-stabilized artillery projectile toward a stationary or a mobile target, comprising the steps of:

a) prior to firing of the projectile, transmitting previously determined target data and control data, which initially fix the projectile flight course toward the target, as reference data to an electronic control device with memory of the projectile;

b) after the projectile is fired, measuring the actual position of the projectile with the aid of at least one satellite navigational receiver, disposed in the projectile, and comparing, with the aid of the electronic control device, the measured position data and the reference data transmitted to the control device prior to firing to obtain correction values;

c) reducing the velocity and the spin of the projectile at a given distance from the firing position by deploying swing-out, spin-stabilized brake fins to realize guidance of the projectile such that the projectile flight changes from a spin-stabilized flight to a fin-stabilized flight condition and by making use of the spin-stabilized brake fins as lift surfaces after the brake fins are immovably fixed; and, d) correcting the correction values obtained as a result of the comparison to corresponding signal values, and using these signal values to effect an aerodynamic guidance of the projectile to the target by control of pivoting, rotating projectile fins that are swingable out of the projectile.

2. A method according to claim 1, further comprising further reducing the projectile velocity with the aid of a parachute brake.

3. A method according to claim 2, wherein the aerodynamic guidance of the projectile is carried out only if the projectile velocity is $\leqq$200 m/s and the roll rate has a value of <10 Hz.

4. An autonomously guided, spin-stabilized artillery projectile, comprising:

a) a projectile body;

b) a parachute brake that is jettisonable and a spin-stabilized brake, composed of several fold-out fins, arranged at a tail region of the artillery projectile body, c) a plurality of rotating fins, designed for the projectile guidance, located in front of a mass center of the projectile and distributed over the circumference of the projectile body, with the fins being mounted to be pivoted outwardly via servomotors and to be swing back and fitted, via slots in the circumference of the projectile body, into the projectile body;

d) at least one satellite navigational receiver system arranged in the projectile body as a sensor for determining the projectile position; and, e) an electronic control device which is disposed in the projectile body and which determines trajectory correction data, as well as the respective roll position of the projectile from target data transmitted to this projectile prior to firing and stored in a memory of the device as well as from projectile position data determined during flight by the satellite navigational receiver system, and which then determines control data for the servomotors during a guidance phase from the resulting data and subsequently transmits said control data to the servomotors for guiding the projectile after it has slowed down, the spin-stabilization of the projectile has ended and the rotating fins are extended.

5. An artillery projectile according to claim 4, wherein the projectile is provided with a base bleed unit, that is mounted to be jettisoned, at the tail region of the projectile body.

6. An artillery projectile according to claim 4, wherein the rotating fins are arranged in an ogive-shaped nose section of the projectile body.

7. An artillery projectile according to claim 4, wherein the projectile is a carrier projectile for a subcaliber submunition.

8. An artillery projectile according to claim 4, wherein the projectile is a carrier projectile for a subcaliber submunition which, following the guidance operation of the carrier projectable, is accelerated in the target direction by one of separately from and with the carrier projectile.

9. An artillery projectile according to claim 4, wherein the spin-stabilized brake fins are locked in place following the changeover from the spin-stabilization, and thus function as lift surfaces.

* * * * *